US007758278B2

(12) United States Patent
Tamburro

(10) Patent No.: US 7,758,278 B2
(45) Date of Patent: Jul. 20, 2010

(54) SYSTEM AND METHOD FOR STABILIZING PARKING CURB ANCHORS

(76) Inventor: Raymond Tamburro, 266 Tuckahoe Rd., Vineland, NJ (US) 08360

( * ) Notice: Subject to any disclaimer, the term of this patent is extended or adjusted under 35 U.S.C. 154(b) by 45 days.

(21) Appl. No.: 12/050,704

(22) Filed: Mar. 18, 2008

(65) Prior Publication Data

US 2009/0238641 A1 Sep. 24, 2009

(51) Int. Cl.
*E01C 11/22* (2006.01)

(52) U.S. Cl. ..... 404/7; 248/530

(58) Field of Classification Search ..... 404/7; 248/530

See application file for complete search history.

(56) References Cited

U.S. PATENT DOCUMENTS 2,655,225 A * 10/1953 Harris ..... 404/6
2,725,958 A * 12/1955 Porter et al. ..... 404/6
3,209,662 A * 10/1965 Morton ..... 404/6
3,636,829 A * 1/1972 Palmer ..... 404/7
4,089,615 A * 5/1978 Almer et al. ..... 404/6
4,594,021 A * 6/1986 Schafer et al. ..... 404/14
4,762,438 A * 8/1988 Dewing ..... 404/6
4,844,652 A * 7/1989 Schroughan ..... 404/6
5,964,067 A * 10/1999 Lehner et al. ..... 52/220.2
6,308,468 B1 * 10/2001 Caruso ..... 52/165
6,953,180 B1 * 10/2005 Ruvalcaba et al. ..... 248/530
7,344,333 B2 * 3/2008 Iwasaki ..... 404/7
2004/0169121 A1 * 9/2004 Winn ..... 248/530

* cited by examiner

*Primary Examiner*—Gary S Hartmann
(74) *Attorney, Agent, or Firm*—Hunton & Williams LLP

(57) ABSTRACT

A system for anchoring a parking curb is provided which may include an anchoring rod and a plate. The anchoring rod bisects the plate and is parallel to the thickness of the plate. The anchoring rod may bisect the plate through a center point of the plate. The plate may be secured to the anchoring rod. In some embodiments, the anchoring rod and plate can be manufactured as one piece. The plate may be of any suitable shape, including square and rectangular.

8 Claims, 10 Drawing Sheets

SYSTEM AND METHOD FOR STABILIZING PARKING CURB ANCHORS

FIELD OF THE DISCLOSURE

This invention relates to the field of parking curb stabilization. Specifically this invention provides a system and method with a means to stabilize and hold the anchoring object, which is typically a rod or a spike, for a parking curb to prevent the creep caused by expansion and contraction of the substrate below the parking curb.

BACKGROUND OF THE DISCLOSURE

Conventional concrete parking curbs are used to provide a barrier at the head parking spaces. This barrier provides a driver a visual and physical marker on how far to pull into a parking space. Parking curbs are typically made of precast concrete, although other suitable materials, such as rubber and plastic, may be used.

A parking curb may be anchored into a substrate, such as concrete, asphalt, or soil. The anchoring means is conventionally provided by either rods or spikes, typically made of steel or rebar.

Over time, in response to changing temperature, frost, and settling, the substrate may experience expansion and contraction. This expansion and contraction of the substrate can cause movement of the anchoring means due to pressure exerted by the substrate on the anchoring means. Specifically, the anchoring means can be forced upward, past the top of the parking curb, which the direction of least resistance.

If the anchoring means is driven far enough upward, it becomes a hazard both to people and vehicles. Specifically, a person could trip over the protruding anchor rod, leading to a possible fall and subsequent injury and a vehicle's bumper can catch on the protruding anchor causing physical damage to the vehicle. The risk of this happening is especially pronounced for vehicles that sit low to the ground, such as high performance automobiles. The damage caused to the vehicle can range from moderate, such as a scrape, to severe, such as ripping off the bumper or a portion of the bumper or causing undercarriage damage to the vehicle.

This and other drawbacks exist.

SUMMARY OF THE INVENTION

Various embodiments of the present disclosure provide a means to secure an anchoring means of a parking curb in place to prevent movement of the anchoring means due to expansion or contraction of an anchoring substrate.

A system for anchoring a parking curb is provided which may include an anchoring rod and a plate. The anchoring rod bisects the plate and is parallel to the thickness of the plate. The anchoring rod may bisect the plate through a center point of the plate. The plate may be secured to the anchoring rod. In some embodiments, the anchoring rod and plate can be manufactured as one piece. The plate may be of any suitable shape, including square and rectangular.

The material used for the anchoring rod comprises any suitable material and may include: rebar, steel, or carbon fiber.

A parking curb system is also provided which may include a parking curb having one or more holes extending in a vertical direction through the thickness of the curb, an anchoring rod, and a plate. The anchoring rod may through the plate whereby the anchoring rod bisects the plate and is parallel to the thickness of the plate. The anchoring rod length extending above the top surface of the plate may fit into the one or more holes in the parking curb. The anchoring rod length extending below the bottom surface of the plate may be inserted into a suitable substrate to hold the parking curb in place.

Further, the parking curb may have a recess manufactured to fit the plate in the bottom of the parking curb. This recess can extends transversely from side to side of the bottom of the parking curb. The recess may also not extend transversely from side to side of the bottom of the parking curb.

A method for anchoring a parking curb is provided, wherein the method may include, inserting the anchoring rod of the anchoring into a substrate; and lowering the parking curb onto the anchoring rod so that the parking curb rests upon the plate fitted to the anchoring rod.

Additional embodiments may be considered.

DETAILED DESCRIPTION OF THE PREFERRED EMBODIMENTS

Figure 1:
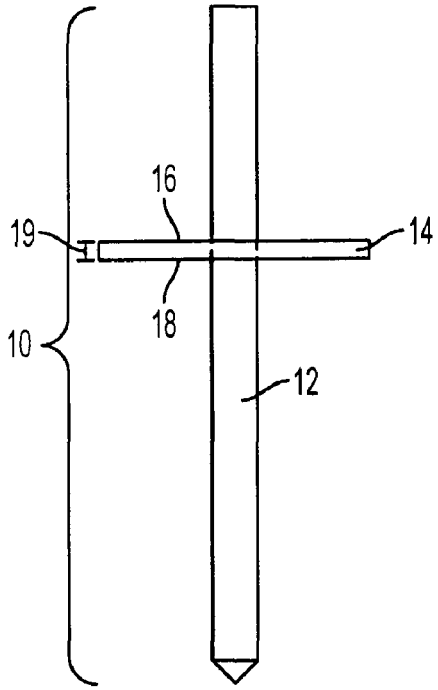
FIG. 1 is a side view of an anchor system comprising an anchoring rod and a plate of the exemplary embodiment of the disclosure.
Figure 2:
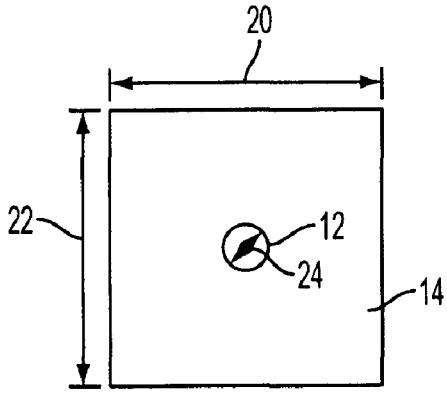
FIG. 2 is a top view of the anchoring system comprising an anchoring rod and a plate of the exemplary embodiment of the disclosure.

Referring now to the drawings and particularly FIG. 1 and FIG. 2, an exemplary embodiment of the present disclosure is shown. An anchoring system 10 may include an anchoring rod 12 and plate 14. The anchoring rod 12 may be made of steel or rebar, although other suitable materials may be used. The anchoring rod 12 has a diameter 24 and extends in an axial direction which is perpendicular to the diameter. The plate 14 has a width 20, a length 22, and a thickness 19; the thickness 19 of plate 14 is perpendicular to the length 22 and width 29. The plate 14 may fit around the diameter 24 of anchoring rod 12 so that the anchoring rod 12 extends from a point below the bottom surface 18 of the plate 14, through the thickness 19 of the plate 14 and through a point above the top surface 16 of plate 14 wherein the rod bisects plate 14 in an axial direction through the thickness 19. Plate 14 may be made of steel or any other suitable material capable of withstanding the stresses arising from installation and exposure to the elements of the area where plate 14 is installed. The term rod is used to refer to anchoring rod 12 however other types of suitable anchors may be used, such as a spike.

Plate 14 can be made to slide onto anchoring rod 12 prior to installation in the parking curb. Also, plate 14 can be manufactured as an integral part of anchoring rod 12, for example anchoring rod 12 and plate 14 being cast or forged as a single component. For example, plate 14 can be slid onto anchoring rod 12 and welded into place. The preferred embodiment of the present invention has plate 14 secured in some manner to anchoring rod 12.

A hole in the middle of plate 14 may be provided of sufficient diameter to fit around the diameter 24 of anchoring rod 12, if anchoring rod 12 and plate 14 are not a manufacture of one unit. For example, if anchoring rod 12 is made of rebar, the diameter of the hole must be such as to take into account the ridges typically found on a rebar rod. In order to provide protection against anchoring rod 12 creeping upward due to expansion and contraction of a substrate, the hole in plate 14 must be such that a snug, friction fit is provided with anchoring rod 12 so that a tight coupling is ensured. Also, the hole in plate 14 may be located in a position other than the center of the plate.

Various embodiments may also use a hinged opening on plate 14 to allow for easier installation on anchoring rod 12. For example, plate 14 may be hinged to open in a horizontal plane to be fit around the diameter 24 of anchoring rod 12. Plate 14 would then be closed once it is in place around anchoring rod 12. The hinged opening may then be welded or clamped shut to prevent future opening of the plate. Also, the ability to open may be left intact for future removal of the plate.

Plate 14 may be of sufficient thickness 19 to provide protection against the creep of anchoring rod 12 without buckling or failing.

Figure 3A:
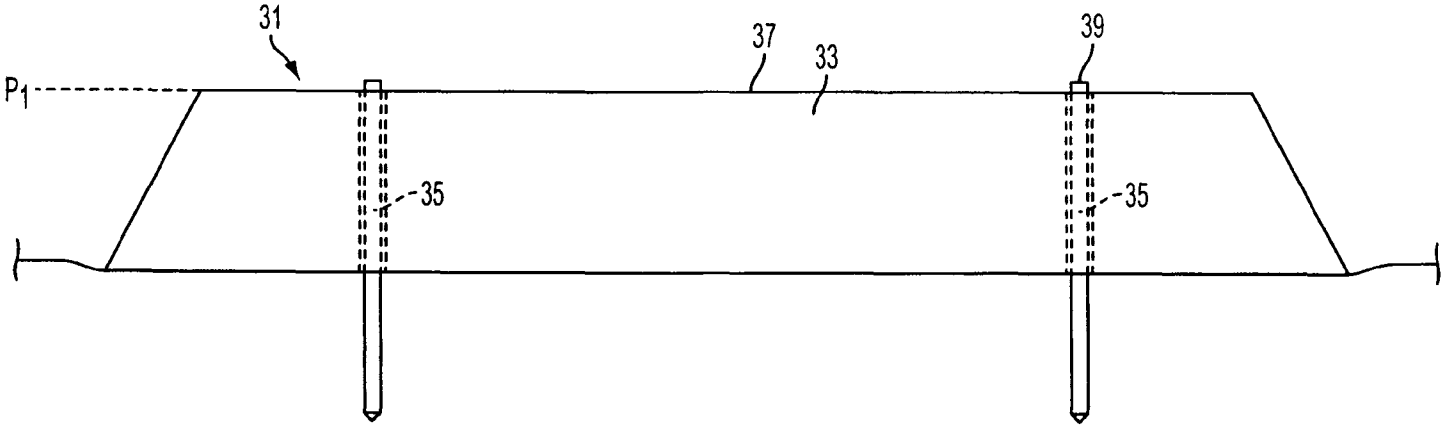
FIG. 3A is side elevation view of a prior art parking curb with anchors.

FIG. 3A illustrates a prior art parking curb system with anchors. A plane P1 is defined to lie parallel to and in contact with the top 37 of parking curb 33. Two anchors 35 are provided. It can be appreciated that the top 39 of anchor 35 intersects plane P1 and protrudes above the top 37 of parking curb 33 in a plane perpendicular to plane P1. This protrusion of anchor 35 is due to contraction and expansion of the substrate.

Figure 3B:
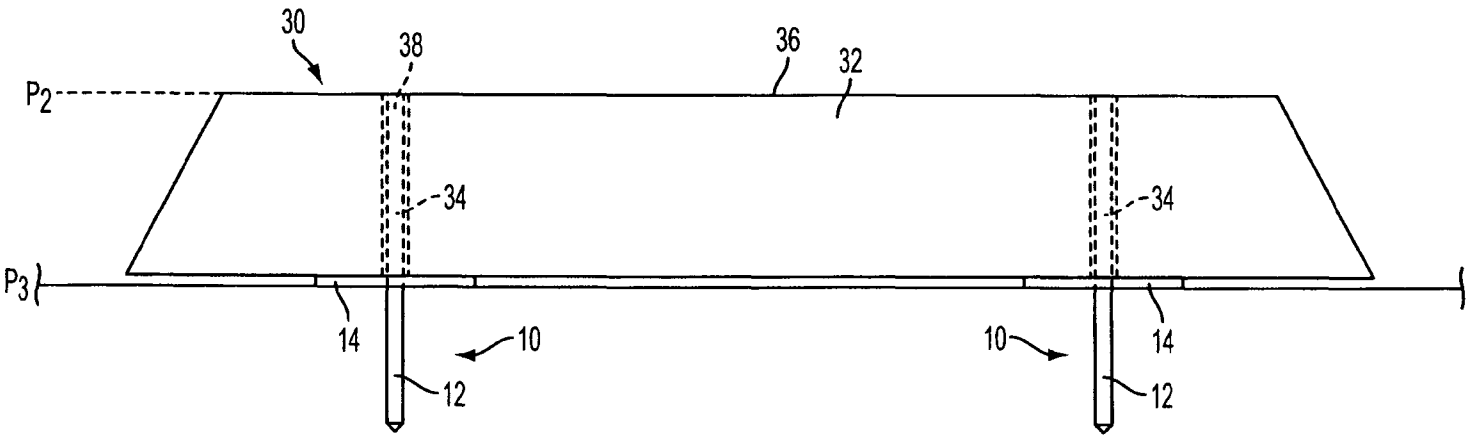
FIG. 3B is a side elevation view of a parking curb system comprising a parking curb with the anchoring rods and plates of an exemplary embodiment of the present disclosure.
Figure 4:
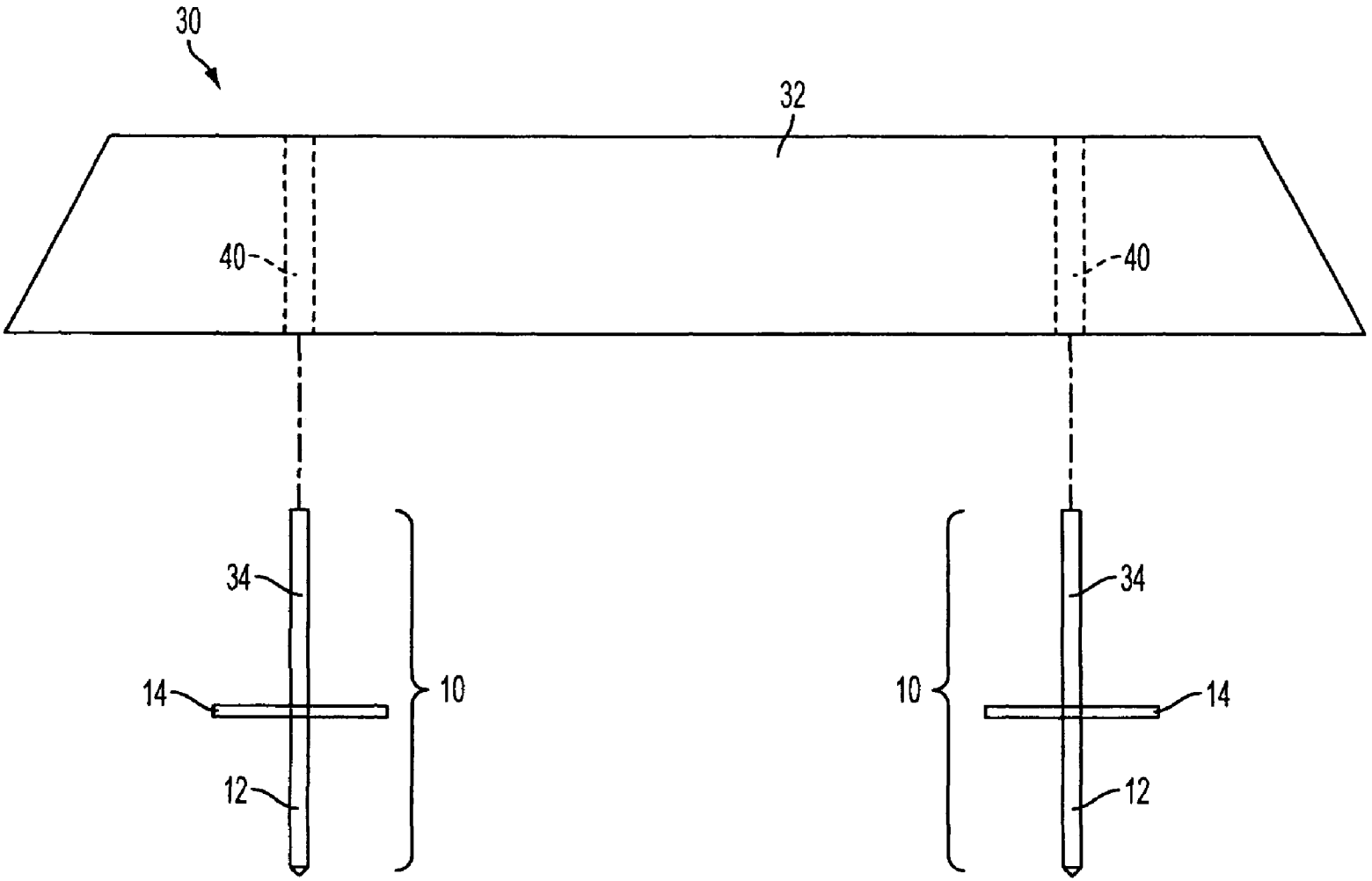
FIG. 4 is a side view of a parking curb system illustrating the individual components of the system.
Figure 5A:
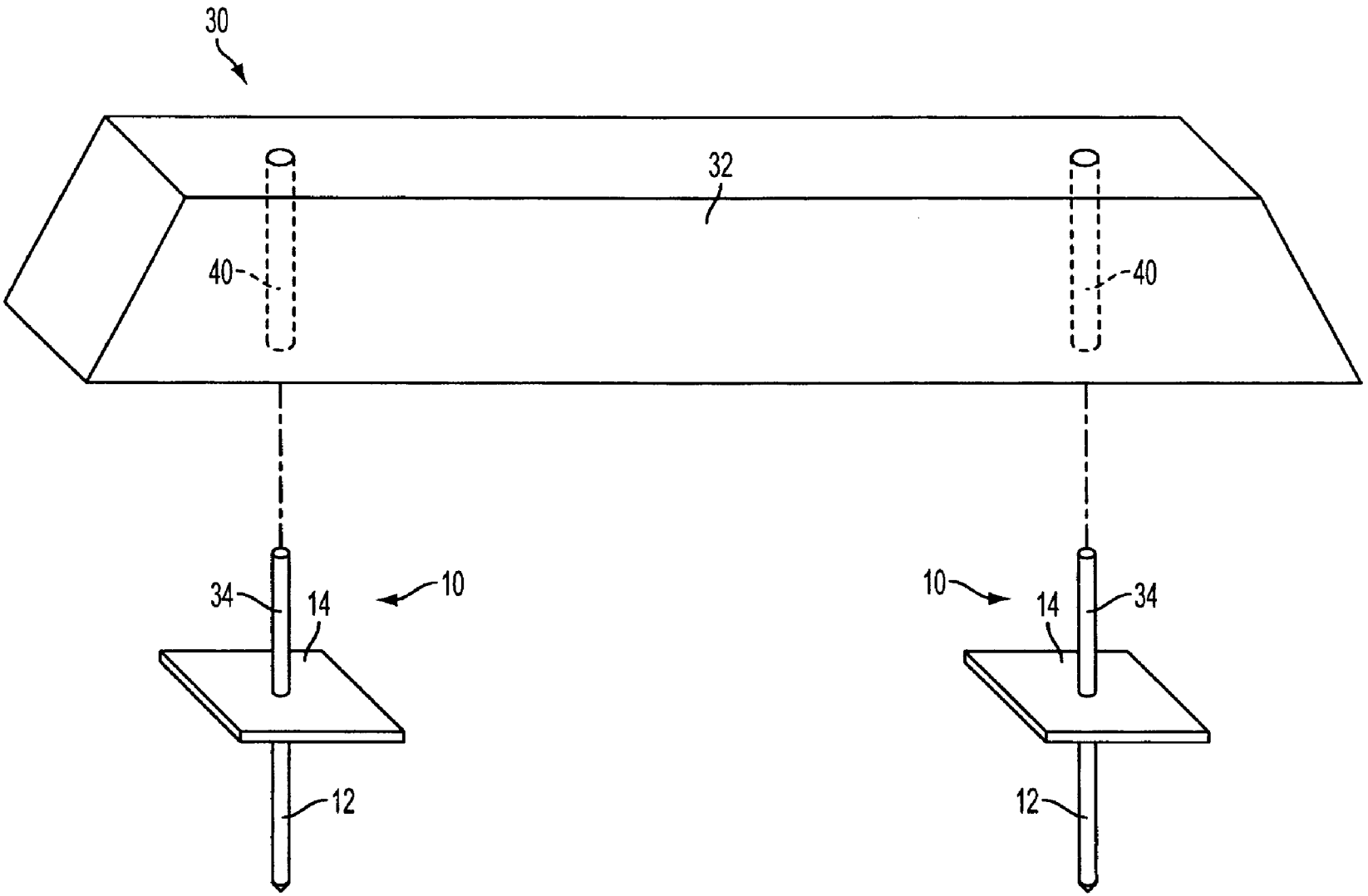
FIG. 5A is a perspective view of a parking curb system illustrating the individual components of the system.
Figure 5B:
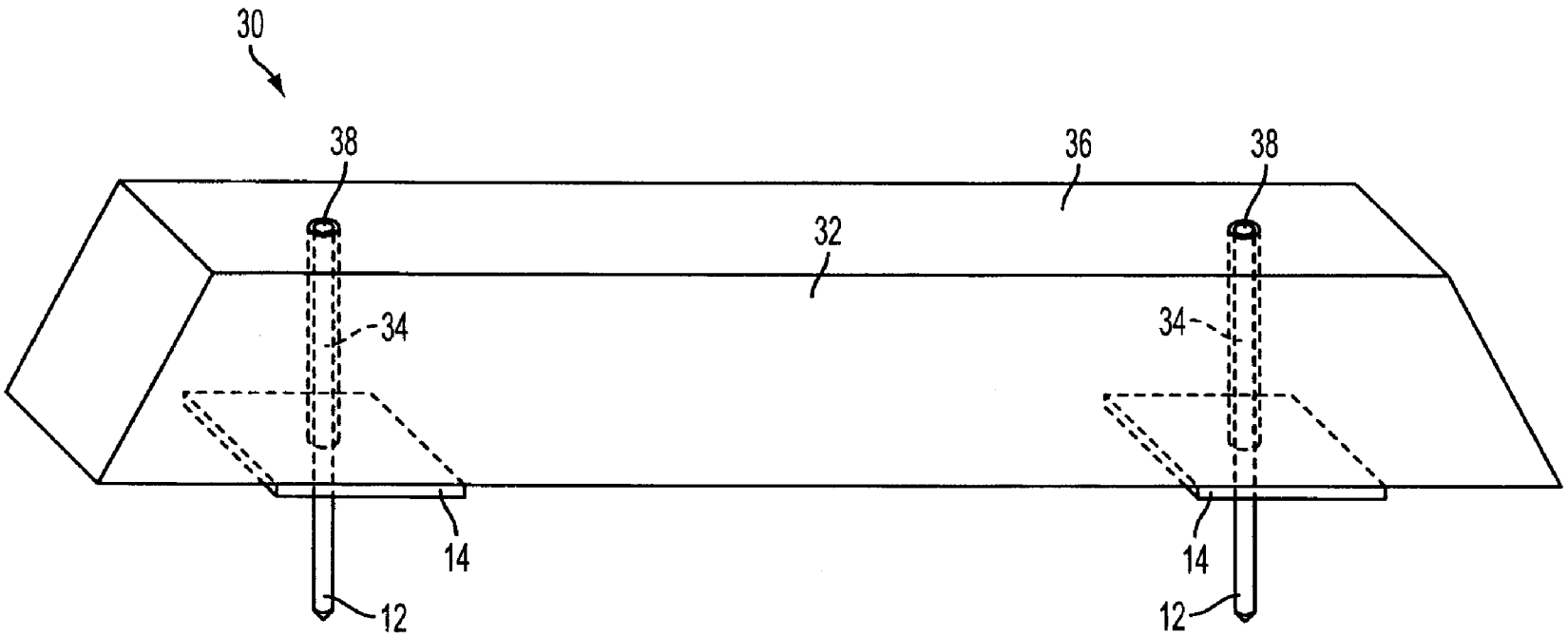
FIG. 5B is a perspective view of a parking curb system comprising a parking curb with the anchoring rods and plates of an exemplary embodiment of the present disclosure.

FIG. 3B illustrates a view of the preferred embodiment of the present invention showing a parking curb system 30 comprising anchoring system 10 installed in a parking curb 32. FIGS. 4, 5A, and 5B provide additional views of parking curb system 30 with anchor system 10 of the preferred embodiment of the present invention installed in parking curb 32. Parking curb 32 can be made of any suitable material, such as concrete, rubber, or plastic. Concrete is typically used in parking curbs. Parking curb 32 may two anchor points, although it is to be appreciated that additional anchor points also could be used. Plane P3 is shows the top surface of the substrate.

Returning to FIG. 3B, it can be seen that a plane P2 is defined that lies parallel to and in contact with the top 36 of parking curb 32. The shaft 34 of anchor system 10 lies completely within parking curb 32. Indeed it can be seen that top 38 of shaft 34 does not protrude above nor intersect with plane P2. FIG. 5B also illustrates this feature from a different perspective.

FIG. 4 provides an illustration of an embodiment of the present disclosure showing the components of parking curb system 30 which includes parking curb 32 with hole 40 for anchoring system 10. Shaft 34 of anchoring rod 12 fits into hole 40. Plate 14 is shown in place on shaft 34 of anchoring rod 12.

Dimensions of plate 14 may be such that plate 14 may fit completely under parking curb 32 with no protrusion from under the edges of curb 32, as illustrated in FIG. 5B. Also, plate 14 could be made in an oval or circular shape instead of the square shape shown. A rectangular shape may also be used for plate 14.

An explanation of how various embodiments of the disclosure work will next be provided. Anchoring rod 12 may be fitted with plate 14 to form anchoring system 10. The anchor system 10 of anchoring rod 12 and plate 14 may then be installed into a substrate. As noted above, the substrate may be concrete, asphalt, or soil. Other substrates may be used as is known in the art. The installation of parking curb system 30 is anticipated to be at the head of parking space. Typically two anchor points may be required for a standard parking curb, although other types of parking curbs may require additional anchoring points. Once anchoring system 10 is installed in the substrate, parking curb 32 may be fitting into place over anchoring system 10 and lowered into place. It is anticipated that parking curb 32 will rest upon plate 14, which in turn rests upon plane P3 of the substrate which is the top surface of the substrate.

Figure 6:
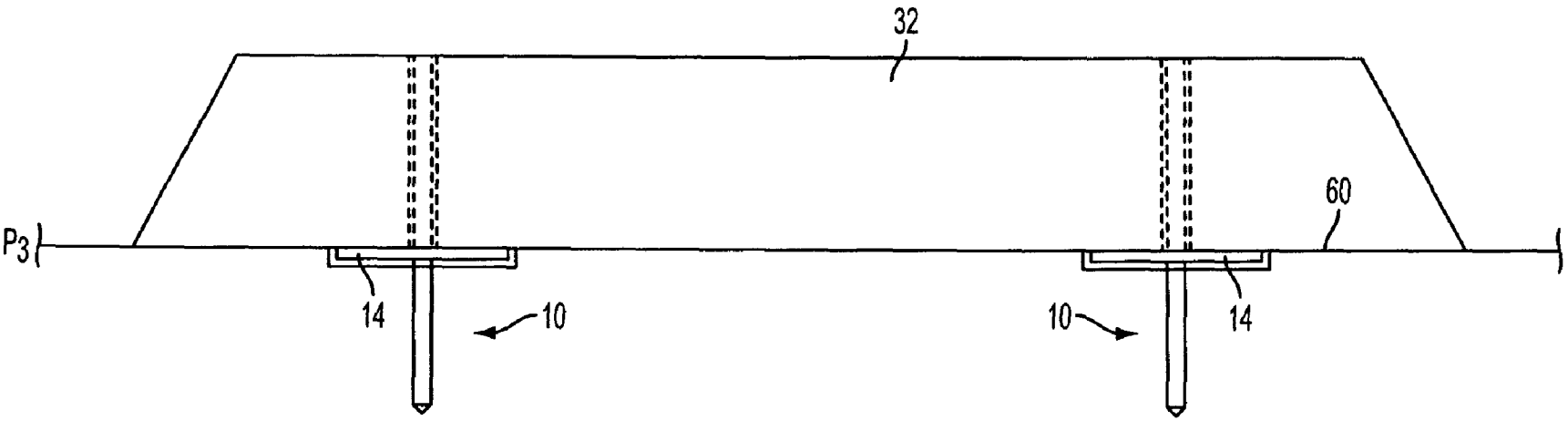
FIG. 6 is a side view of an embodiment of the present disclosure illustrating the plates recessed into the substrate.

In various embodiments, a recess may be made in the substrate which allows plate 14 to sit in said recess with the upper surface of plate 14 flush with the substrate surface. FIG. 6 illustrates this feature. Plate 14, when installed as part of anchoring system 10, on anchoring rod 12, sits below the surface level (plane P3) of the substrate; the upper surface of plate 14 is flush with plane P3. Parking curb 32, therefore sits at ground level, with no gap between bottom 60 of parking curb 32 and the surface level (plane P3) of the substrate.

Figure 7A:
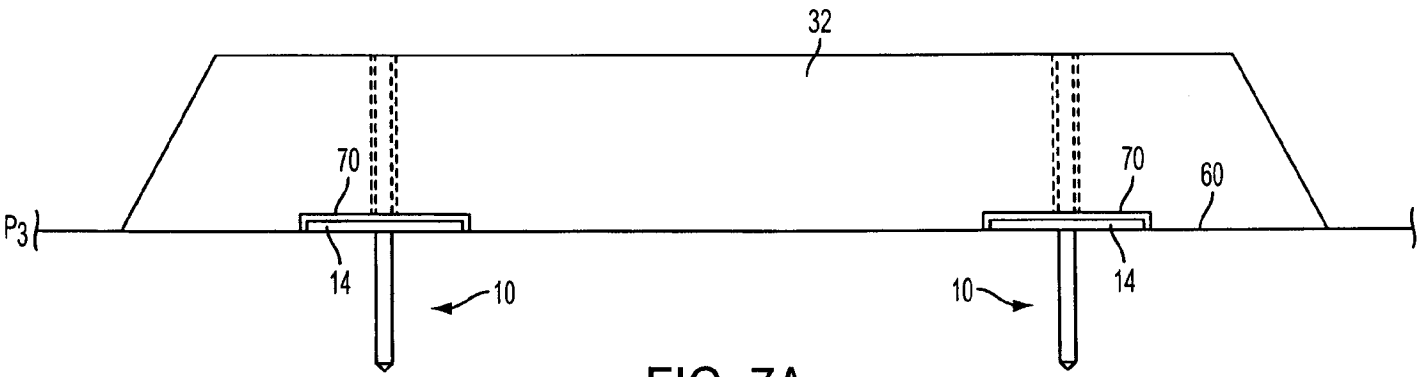
FIG. 7A is a side view of an embodiment of the present disclosure illustrating a parking curb with recesses for the plates.
Figure 7B:
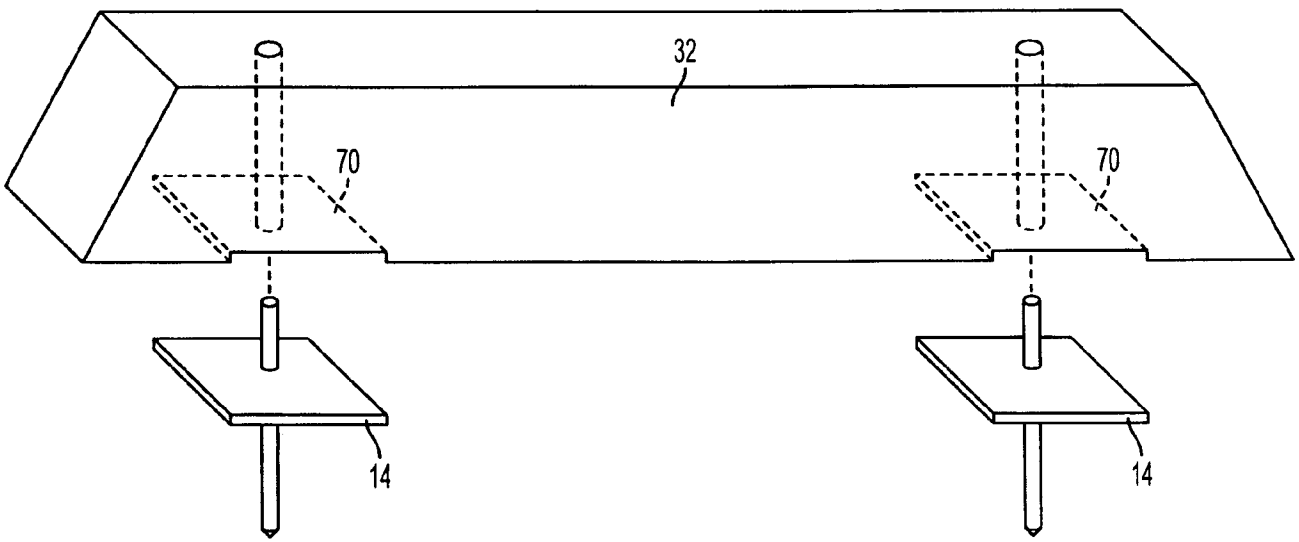
FIG. 7B is a perspective view of an embodiment illustrating the plate recesses in the parking curb.
Figure 7C:
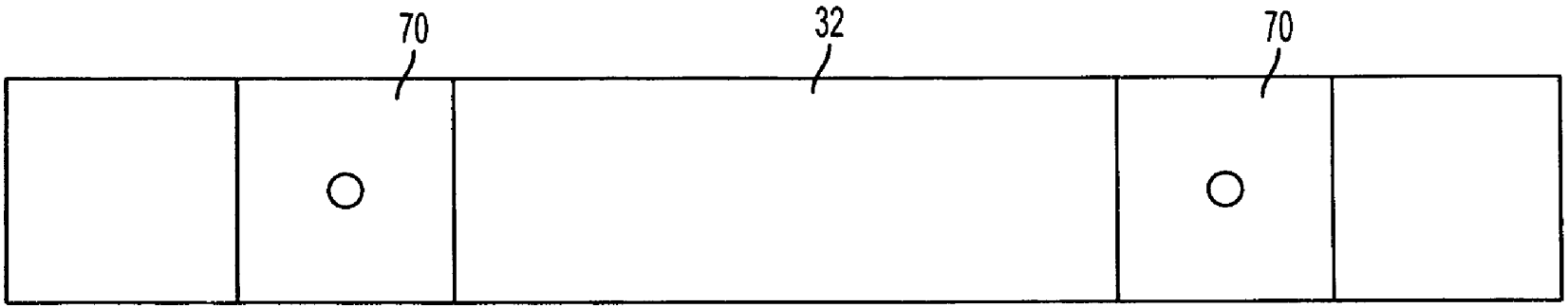
FIG. 7C is a bottom view of the parking curb from FIGS. 7A and 7B.

In various embodiments, a recess 70 may be manufactured in parking curb 32. Recess 70 is illustrated in FIGS. 7A, 7B, and 7C. When anchoring system 10 is installed in parking curb 32, plate 14 sits within the recess 70 of parking curb 32 so that bottom 60 of parking curb 32 lies on plane P3. Recess 70 runs transversely across the bottom 60 of parking curb 32. FIG. 7C provides a bottom view of parking curb 32 with recess 70. Also, recess 70 may be made in other shapes to conform to the shape of plate 14.

Figure 8A:
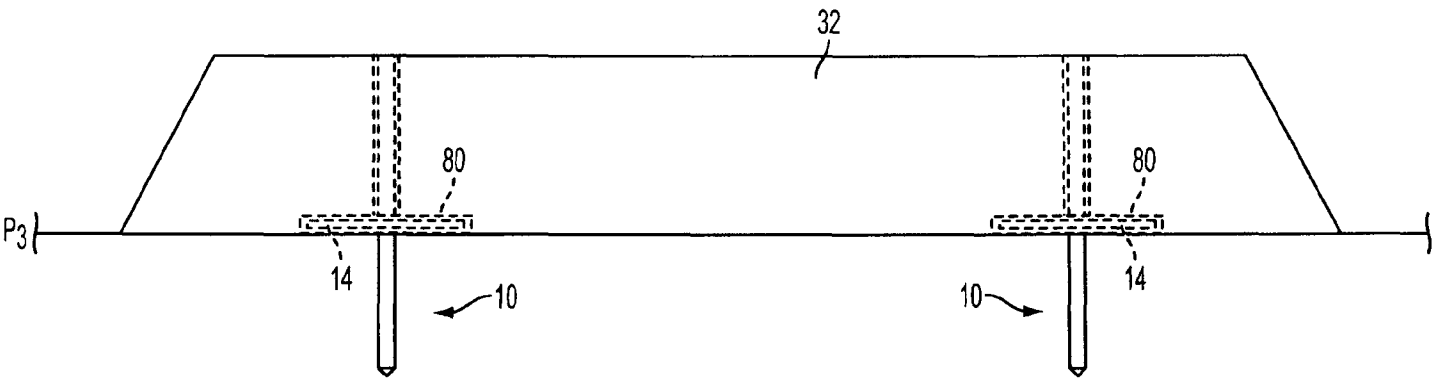
FIG. 8A is a side view of an embodiment of the present disclosure illustrating the plates completely recesses within the parking curb.
Figure 8B:
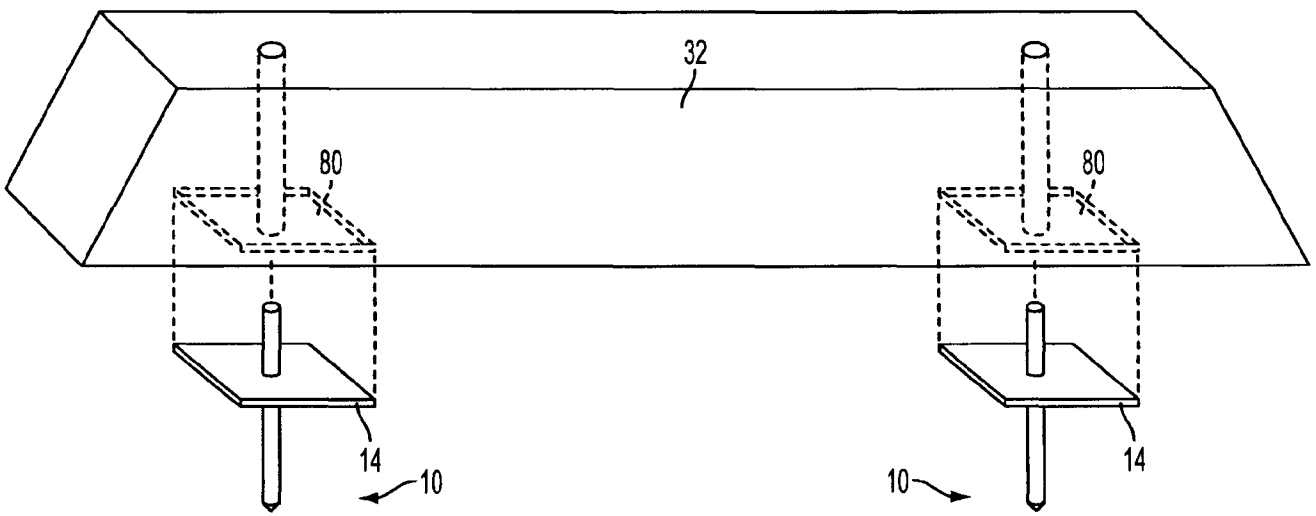
FIG. 8B is a perspective view of an embodiment of the present disclosure illustrating the plates completely recessed within the parking curb.
Figure 8C:
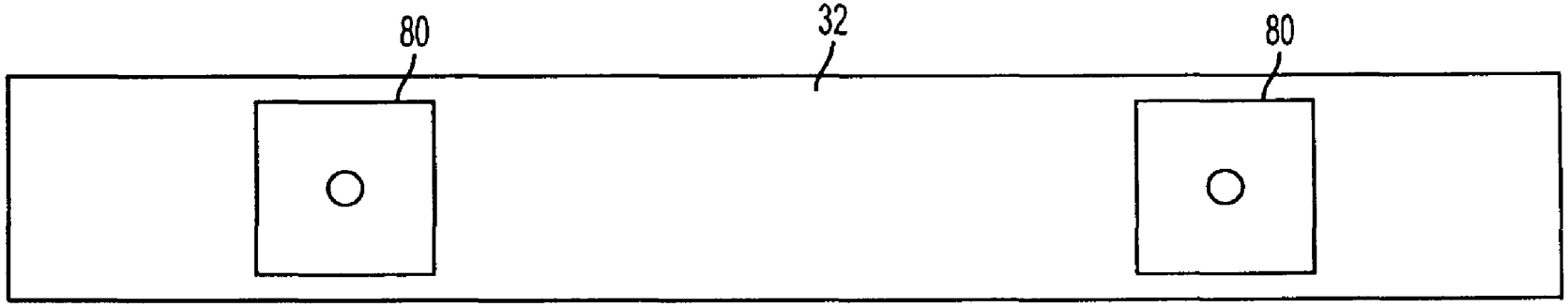
FIG. 8C is a bottom view of the parking curb from FIGS. 8A and 8B.

FIGS. 8A, 8B, and 8C show another embodiment of the present disclosure. A recess 80 is manufactured in parking curb 32 in which plate 14 sits. Recess 80 does not run the complete transverse width of parking curb 32. The resulting effect is that plate 14 lies completely underneath parking curb 32 and parking curb 32 lies on plane P3, i.e., plate 14 is not visible once parking curb 32 is placed onto anchoring system 10. FIG. 8C provides a bottom view of parking curb 32 with recess 80. Also, recess 80 may be made in other shapes to conform to the shape of plate 14.

Once parking curb 32 is in place, plate 14 may provide for the transfer of a pressure force caused by expansion and contraction of the substrate. Typically, expansion and contraction of the substrate may be caused by temperature variations. The temperature variations would typically cause the anchoring rod 12 to be driven upward over time. Plate 14 provides additional surface area to absorb the pressure force caused by the expansion and contraction of the substrate, effectively preventing anchoring rod 12 from being driven upward so that shaft 34 protrudes past the top 36 of parking curb 32 and intersects plane P2. The pressure force acts upon anchoring rod 12 and plate 14. Since plate 14 is coupled to rod 12, a portion of the pressure force is transferred by anchoring rod 12 to plate 14, which may serve to transfer the pressure force in a radial direction away from the central axis of anchoring rod 12. The remaining force transmitted onto the central axis of anchoring rod 12 is not sufficient to drive anchoring rod 12 upward. The weight of parking curb 32 in turn keeps plate 14 from being pushed upward from the pressure force exerted by the substrate acting directly on plate 14.

In various embodiments where plate 14 lies recessed in parking curb 32, plate 14 may provide added anchoring force to prevent lateral or transverse movement of parking curb 32 against external forces applied to parking curb 32.

In the foregoing description certain terms have been used for brevity, clarity, and understanding. However no unnecessary limitations are to be implied therefrom because such terms are for descriptive purposes and are intended to be broadly construed. Moreover, the descriptions and illustrations herein are by way of examples and the invention is not limited to the details shown and described.

In the following claims any feature described as a means for performing a function shall be construed as encompassing any means known to those having skill in the are to be capable of performing the recited function and shall not be deemed limited to the particular means shown in the foregoing description or mere equivalents thereof.

What is claimed is:

1. A parking curb system comprising:

a parking curb having one or more cylindrical channels extending in a vertical direction through a height of the parking curb, wherein the height of the parking curb extends vertically from a lower surface of the parking curb to an upper surface of the parking curb; and a means for anchoring the parking curb to a substrate, wherein the means for anchoring the parking curb fits within the one or more cylindrical channels, wherein the means for anchoring comprises at least a parking curb anchor rod and a plate fitted around the parking curb anchor rod so that the plate is perpendicular to an axial length of the parking curb anchor rod, the parking curb anchor rod being designed to fit within the one or more cylindrical channels and the top surface of the plate being designed to fit adjacent to the lower surface of the parking curb and an upper surface of the substrate, wherein the parking curb has a recess configured to fit the plate into which the plate fits when coupled to the parking curb, the recess extends transversely from side to side of the bottom of the parking curb, wherein the recess has a recess width that is less than a bottom width of the parking curb such that the recess is surrounded on each of four sides by a boundary defined by a lip integral to the bottom of the parking curb, and wherein a combination of the plate and the parking curb prevents movement of the parking curb anchor rod due to forces applied by the substrate.

2. A combination of a parking curb and an anchor comprising:

a parking curb having one or more cylindrical channels extending in a vertical direction through a height of the parking curb wherein the height of the parking curb extends vertically from a lower surface of the parking curb to an upper surface of the parking curb;

an anchoring rod including a rod length extending in an axial direction and a rod diameter extending perpendicular to the rod length, the rod diameter being such that the anchoring rod fits within the one or more cylindrical channels; and a plate including a plate length, a plate width, and a plate thickness extending in a direction perpendicular to the plate length and plate width wherein the plate has a top surface and a bottom surface separated by the plate thickness, the anchoring rod extending in a vertical direction from a point below the bottom surface of the plate through the plate thickness to a point above the top surface of the plate whereby the anchoring rod bisects the plate and is parallel to the plate thickness, and the anchoring rod length extending above the top surface of the plate fitting into the one or more cylindrical channels in the parking curb, wherein the top surface of the plate is located below the lower surface of the parking curb when coupled to the parking curb, wherein the parking curb has a recess configured to fit the plate into which the plate fits when coupled to the parking curb, the recess extends transversely from side to side of the bottom of the parking curb, wherein the recess has a recess width that is less than a bottom width of the parking curb such that the recess is surrounded on each of four sides by a boundary defined by a lip integral to the bottom width of the parking curb, and the plate and the parking curb, when coupled together, prevent vertical movement of the anchoring rod due to applied forces external to the parking curb system.

3. The combination of claim 2 wherein the anchoring rod and plate comprise a single piece.

4. The combination of claim 2 wherein the plate is secured to the anchoring rod.

5. The combination of claim 2 wherein the anchoring rod bisects the plate through a center point of the plate.

6. The combination of claim 2 wherein the plate is square in shape.

7. The combination of claim 2 wherein the plate is rectangular in shape.

8. In the combination of claim 4, including a means for securing the plate to the anchoring rod.

* * * * *